US006167741B1

(12) United States Patent
Matsuoka

(10) Patent No.: US 6,167,741 B1
(45) Date of Patent: Jan. 2, 2001

(54) NOISE-REDUCING STRUCTURE OF A PROCESSING MACHINE

(75) Inventor: Mitsuo Matsuoka, Osaka (JP)

(73) Assignee: Umix Co., Ltd., Osaka (JP)

( * ) Notice: Under 35 U.S.C. 154(b), the term of this patent shall be extended for 0 days.

(21) Appl. No.: 09/300,316

(22) Filed: Apr. 28, 1999

(30) Foreign Application Priority Data

Mar. 9, 1999 (JP) ..... 11-061389

(51) Int. Cl.[7] ..... B21D 24/12
(52) U.S. Cl. ..... 72/350; 72/417
(58) Field of Search ..... 72/343, 352, 347, 72/350, 351, 417, 453.13

(56) References Cited

U.S. PATENT DOCUMENTS 2,843,175 * 7/1958 Black et al. ..... 72/315
4,635,466 * 1/1987 Seki et al. ..... 72/453.13
4,821,552 * 4/1989 Baur et al. ..... 72/453.13
5,231,907 8/1993 Matsuoka .
6,016,680 * 1/2000 Matsuoka ..... 72/350

* cited by examiner

*Primary Examiner*—Lowell A. Larson
(74) *Attorney, Agent, or Firm*—Birch, Stewart, Kolasch & Birch, LLP

(57) ABSTRACT

A noise-reducing structure of a processing machine reduces the noise generated when a movable member of the processing machine abuts against a workpiece located on a workpiece holder of the processing machine. The processing machine may be a drawing die including a punch, a blank holder fitted around the punch and vertically movably supported by a cushion pin, and a vertically movable die disposed to face the punch. The workpiece may be a thin plate which is placed on the blank holder. As the die is lowered, the thin plate is sandwiched between the blank holder and the die for drawing the thin plate by the punch. A lower die base plate is provided with a pivotable lever member for pushing the blank holder so that the blank holder begins movement before the die collides against the thin plate. An operation cam for driving the lever member is disposed at a position on the die facing the lever member, and the die collides against the thin plate on the blank holder after the blank holder is in motion.

31 Claims, 9 Drawing Sheets

NOISE-REDUCING STRUCTURE OF A PROCESSING MACHINE

BACKGROUND OF THE INVENTION

1. Field of the Invention

The present invention relates to a silent structure of a processing machine, a silent structure of a pressing machine, a silent structure of a pressing die, and more particularly, to a silent structure of a drawing die and a silent run-up unit thereof used when a metal plate part such as an automobile or an electric home appliance is subjected to a drawing working.

2. Description of Background Art

The background of the present invention will be explained based on the drawing die as an example.

FIG. 9 shows one example of the drawing die. The drawing die comprises a punch 101 located at a central position of the drawing die, a blank holder 103 fitted around the punch 101 and vertically movably supported by a cushion pin 102, and a die 104 disposed such as to oppose the punch 101 for vertical movement. The reference number 105 represents an air vent.

A lower die 109 comprising the punch 101 and the blank holder 103 is fixed to a bolster 106 of a pressing machine, and an upper die 110 comprising the die 104 is fixed to a ram 107 of the pressing machine. The upper die 110 moves vertically by driving the pressing machine. The blank holder 103 is supported by the cushion pin 102, the cushion pin 102 is moved vertically by a cushion device of the pressing machine and with this movement, the blank holder 103 is also moved vertically.

A drawing processing will be explained. First, the blank holder 103 is moved up to a position shown with phantom lines by the cushion pin 102.

Next, a thin plate 108 is placed on the blank holder 103 and the punch 101 as shown with the phantom lines.

Then, if the upper die 110 is lowered, the die 104 collides against the thin plate 108 on the blank holder 103 around the entire outer periphery of the punch 101 so that the thin plate 108 is sandwiched between the blank holder 103 and the die 104. Subsequently, if the upper die 110 is lowered, the thin plate 108 sandwiched between the blank holder 103 and the die 104 is drawn by the punch 101, and when the upper die 110 reaches the bottom dead center, the thin plate 108 is drawn to form a workpiece W.

If the upper die 110 moves up, the blank holder 103 is moved up to the position shown with the phantom lines by the ascending force of the cushion pin 102, and the workpiece W is removed from the punch 101. The die 104 of the upper die 110 is provided with the air vent 105 so that the negative pressure is prevented from being generated between the workpiece W and the die 104 when the workpiece W is dropped by its own weight. Alternatively, the workpiece W may be moved downwardly by a push pin (not shown) biased by a spring, thereby removing the workpiece W from the die 104. The workpiece W removed from the pressing machine is transferred to the a pressing machine of the next step.

In the above described drawing working, when the die 104 collides against the thin plate 108 placed on the blank holder 103, die 104 and the thin plate 108 over the entire outer peripheral surface of the punch 101 (i.e., the thin plate 108 on the blank holder 103) are directly contacted with each other concurrently and since the upward biasing pressure of the cushion 102 may be about 60 to 100 tons in some cases, a great noise of 110 dB or higher is generated. Since a quiet workplace environment is required in recent years, the noise of the drawing die is not socially acceptable.

In order to prevent the noise generated when the die collides against the thin plate on the blank holder of the drawing die, an attempt was made to provide a urethane rubber or a gas spring on the blank holder so that the die collided against the urethane rubber or the gas spring before colliding against the thin plate, thereby absorbing the impact force to reduce the noise. However, a sufficient effect could not be obtained.

Further, so as to prevent the noise from being generated outside, there is an example that the pressing machine is surrounded by a soundproof wall. However, an opening must be formed in the soundproof wall for bringing in and out the workpiece from and to the pressing machine and thus, the noise leaks from the opening. On the other hand, an operator working in the vicinity of the pressing machine surrounded by the soundproof wall is bothered by the great noise.

Further, when the die collides against the thin plate on the blank holder, an attempt was made to reduce the cushion pressure only during a certain time period of initially lowering movement of the cushion pin. However, the cushion device of the pressing machine must be improved, which is too expensive.

SUMMARY AND OBJECTS OF THE INVENTION

Although the above description has been made based on the drawing die of the pressing die as the example, not only the noise of the drawing die, but also a noise of a pressing die sandwiching a thin plate or a workpiece for machining or working is also not socially acceptable.

Further, in relation to the pressing die, the noise of a pressing machine having a pressing die, and the noises of other processing machines for metal or resin are also regarded as not socially acceptable Since a quiet environment is required in recent years, it is required to reduce the noise generated by a processing machine, a pressing machine and a pressing die as small as possible.

Especially in the drawing die, a great noise is generated when a die collides against a thin plate on a blank holder, and it is required to reduce this noise as small as possible.

Thereupon, so as to reduce the noise generated from a processing machine as small as possible, according to the present invention, there is provided a silent structure of a processing machine comprising a stationary bed, a movable member vertically movable with respect to the bed, a pad of a cushion device located below the bed for biasing a cushion pin upwardly, wherein the stationary member is rotatably provided with a run-up lever, the movable member facing the run-up lever is vertically provided with an operation cam, the operation cam acts on the run-up lever before mounted working tools sandwich a workpiece, and the pad is allowed to run up.

Further, so as to reduce the noise generated from a pressing machine as small as possible, according to the present invention, there is provided a silent structure of a pressing machine comprising a stationary bed, a ram vertically movable with respect to the bed, a pad of a cushion device located below the bed for biasing a cushion pin upwardly, wherein the stationary member is rotatably provided with a run-up lever, the ram facing the run-up lever is vertically provided with an operation cam, the operation cam acts on the run-up lever before mounted pressing dies sandwich a thin plate or a workpiece, and the pad is allowed to run up.

Further, so as to reduce the noise generated from a drawing die as small as possible, according to the present invention, there is provided a silent structure of a drawing die comprising a punch, a blank holder fitted around the punch and vertically movably supported by a cushion pin, and a vertically movable die disposed such as to face the punch, a thin plate being placed on a blank holder which is moved up by the cushion pin, the die being lowered, thereby sandwiching the thin plate between the blank holder and the die for drawing the thin plate by the punch, wherein a lower base plate is rotatably provided with a run-up lever for pushing the blank holder for allowing the latter to run up before the die collides against the thin plate, an operation cam for driving the run-up lever is disposed at a position on the die facing the run-up lever, and the die collides against the thin plate on the blank holder after the blank holder runs up.

Furthermore, according to the invention, the operation cam has a cam surface a tilt angle for changing speed.

Further, in order to facilitate the improvement of the existing drawing die to include a silent structure, there is provided a silent run-up unit having a run-up lever and an operation cam for driving the run-up lever.

Further, in order to reduce the noise of a noise source by a pad of the upper die, a silent structure of a pressing die comprises a lower die provided with an operation cam, and an upper die provided at its position facing the operation cam with a run-up lever. Therefore, it can be expected that the noise is reduced.

Furthermore, in a pressing die for sandwiching a thin plate or a workpiece to machine the same, the thin plate or the workpiece is allowed to run up before the thin plate or the workpiece is sandwiched. Therefore, it can be expected that the noise of the pressing die is reduced.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The present invention will be described in detail below based on shown in the accompanying drawings.

To facilitate understanding, a silent structure of a drawing die will be explained first.

Figure 1:
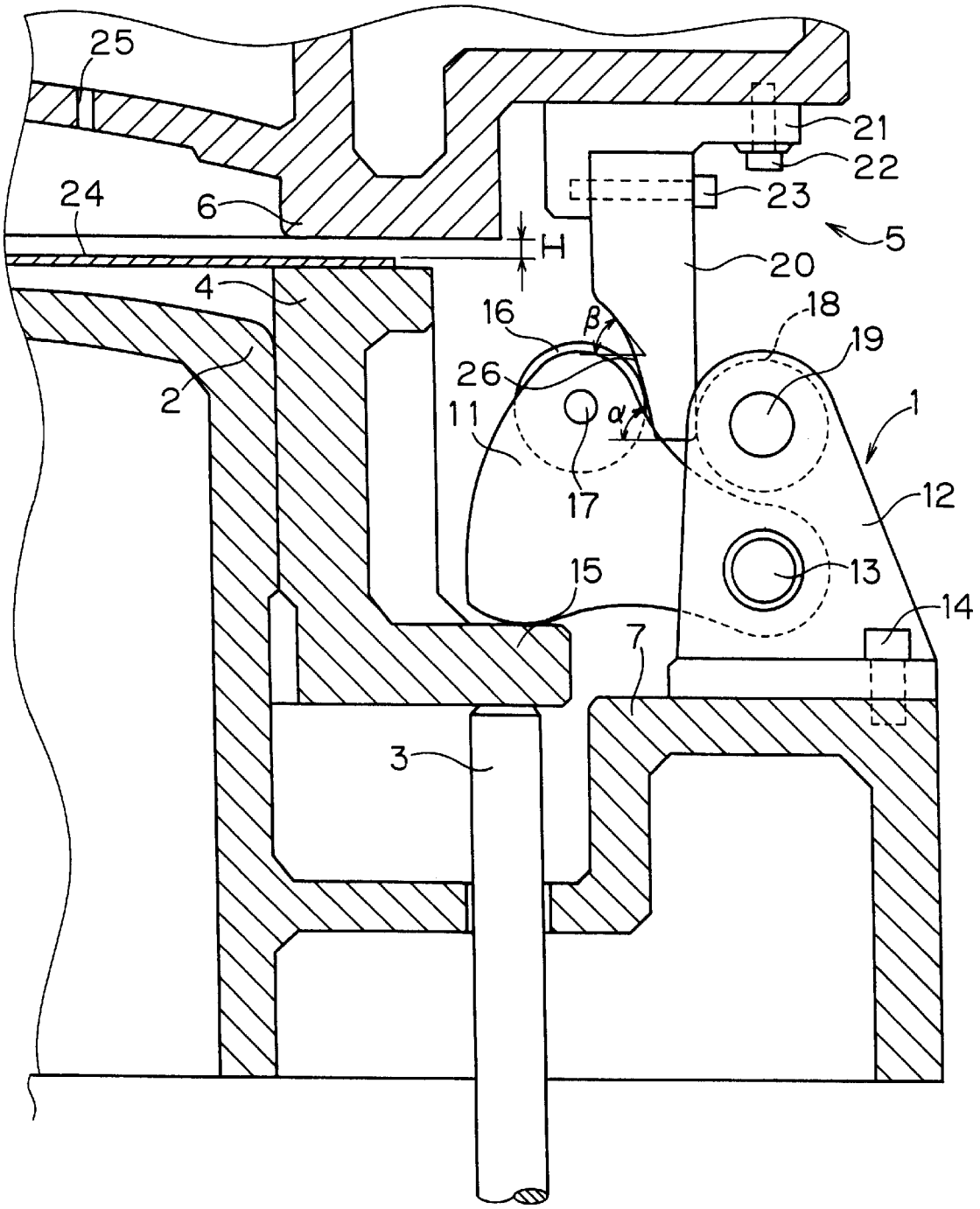
FIG. 1 is a vertical sectional view of an essential portion showing a state in which a run-up lever of the present invention starts operating.

Referring to FIG. 1, a lower die 1 comprises a punch 2, and a blank is holder 4 vertically movably fitted around the punch 2 and supported by a cushion pin 3. A lower die base plate is integrally formed with an outer periphery of the punch 2.

An upper die 5 comprises a die 6 disposed such as to be opposed to the punch 2.

A silent run-up unit is mounted to the lower die base plate 7 and the die 6 for allowing the blank holder 4 to run up. One example thereof is illustrated.

A substantially triangular run-up lever 11 for pushing the blank holder 4 for allowing the latter to run up is rotatably provided around a center shaft 13 of a bracket 12. The bracket 12 is fixed to the lower die base plate 7 by a bolt 14.

The run-up lever 11 is rotatably provided around the center shaft 13 provided on the bracket 12 such that the run-up lever 11 pushes a flange 15 of the blank holder 4.

A roller 16 is rotatably provided around a supporting shaft 17 on an upper portion of the run-up lever 11, and another roller 18 is rotatably provided around a supporting shaft 19 on the bracket 12 at a position opposed to the roller 16.

An operation cam 20 is provided on the die 6 at a position between the rollers 16 and 18. This operation cam 20 is mounted to the die 6 through a supporting mount 21. The supporting mount 21 is fixed to the die 6 by a bolt 22, and the operation cam 20 is fixed to the supporting mount 21 by a bolt 23. The operation cam 20 and the supporting mount 21 may be integrally formed as one unit.

The operation cam 20 has a cam surface 26. A portion of the cam surface 26 which first contacts with the roller 16 when the upper die 5 moves downwardly is formed with a low speed tilt angle $\alpha$. The cam surface 26 is also formed with an intermediate speed tilt angle $\beta$ which is continuously formed with the low speed tilt angle $\alpha$. A connecting portion of the cam surface 26 connecting the low speed tilt angle $\alpha$ and the intermediate speed tilt angle $\beta$ is arced for smoothly connecting both the angles $\alpha$ and $\beta$. Because of the difference in angle between the low speed tilt angle $\alpha$ and the intermediate speed tilt angle $\beta$ of the operation cam 20, the lowering speeds of both the run-up lever 11 and the blank holder 4 can be controlled.

Although the silent run-up unit having the run-up lever 11 and the operation cam 20 has been described above, the present invention should not be limited to this only, and the silent run-up unit may be mounted to the lower die base plate 7 and the die 6 for allowing the blank holder 4 to run up. For example, a push-down rod may be fixed to the die, and the blank holder may run up by the push-down rod.

Next, the operation of this drawing die will be explained.

A thin plate 24 is placed on the punch 2 and the blank holder 4. FIG. 1 shows a state in which the upper die 5 is lowered and the run-up lever 11 starts abutting against the flange 15 of the blank holder 4 by the operation cam 20. A run-up clearance H between the blank holder 4 and the die 6 shown in FIG. 1 is set to such a value that the blank holder 4 collides against the die 6 after run-up and a silent effect can sufficiently be obtained.

Figure 2:
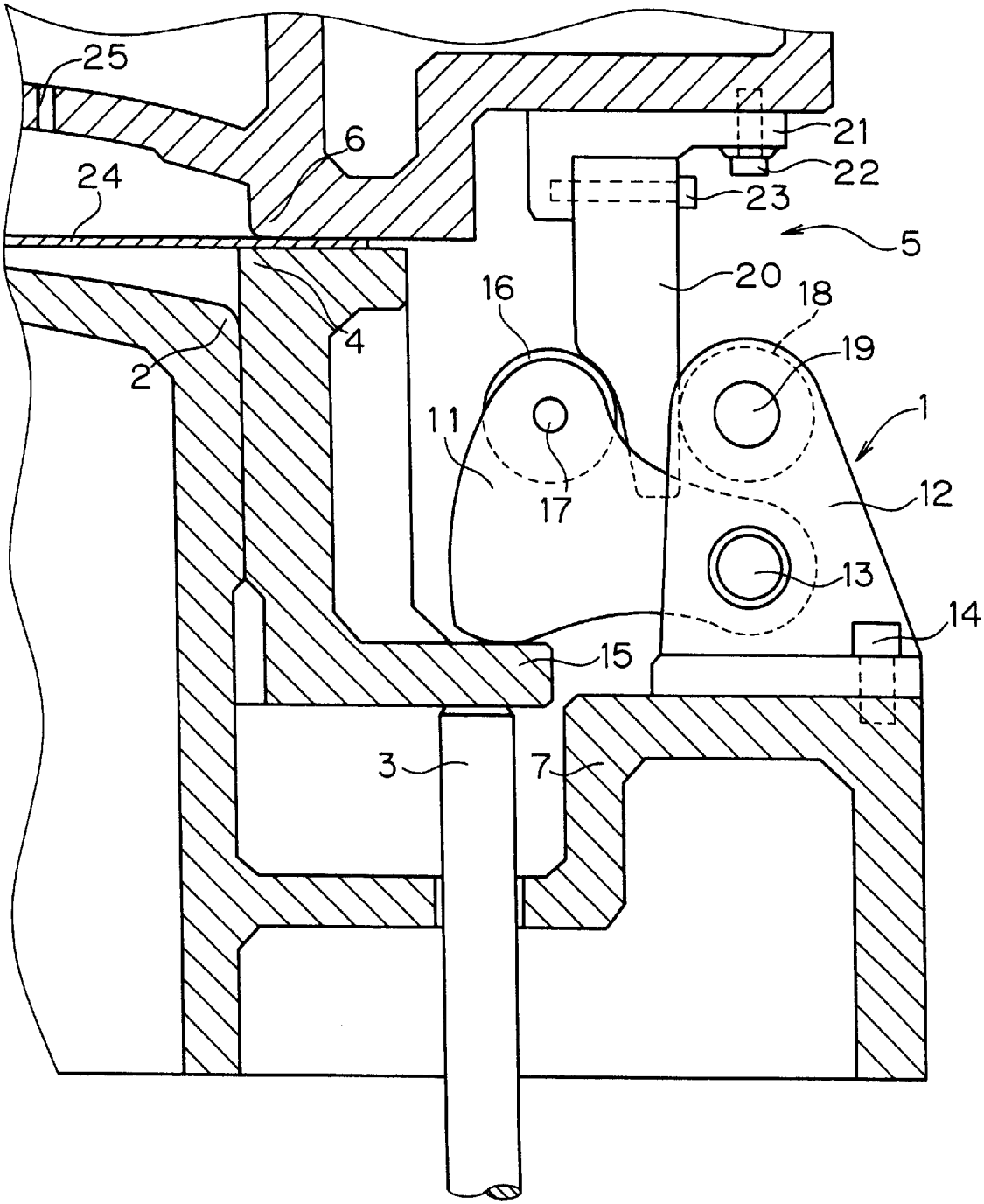
FIG. 2 is a vertical sectional view of an essential portion showing a state in which a blank holder of the invention runs up and abuts against a thin plate on the blank holder.

FIG. 2 shows a state in which the run-up lever 11 allows the blank holder 4 to run up and the die 6 abuts against the thin plate 24 on the blank holder 4. The die 6 abuts against the thin plate 24 on the running blank holder 4 not against the thin plate 24 on the stationary blank holder 4. Since the die 6 does not collide against the stationary thin plate 24 but collides against the running thin plate 24, little noise is generated.

Figure 3:
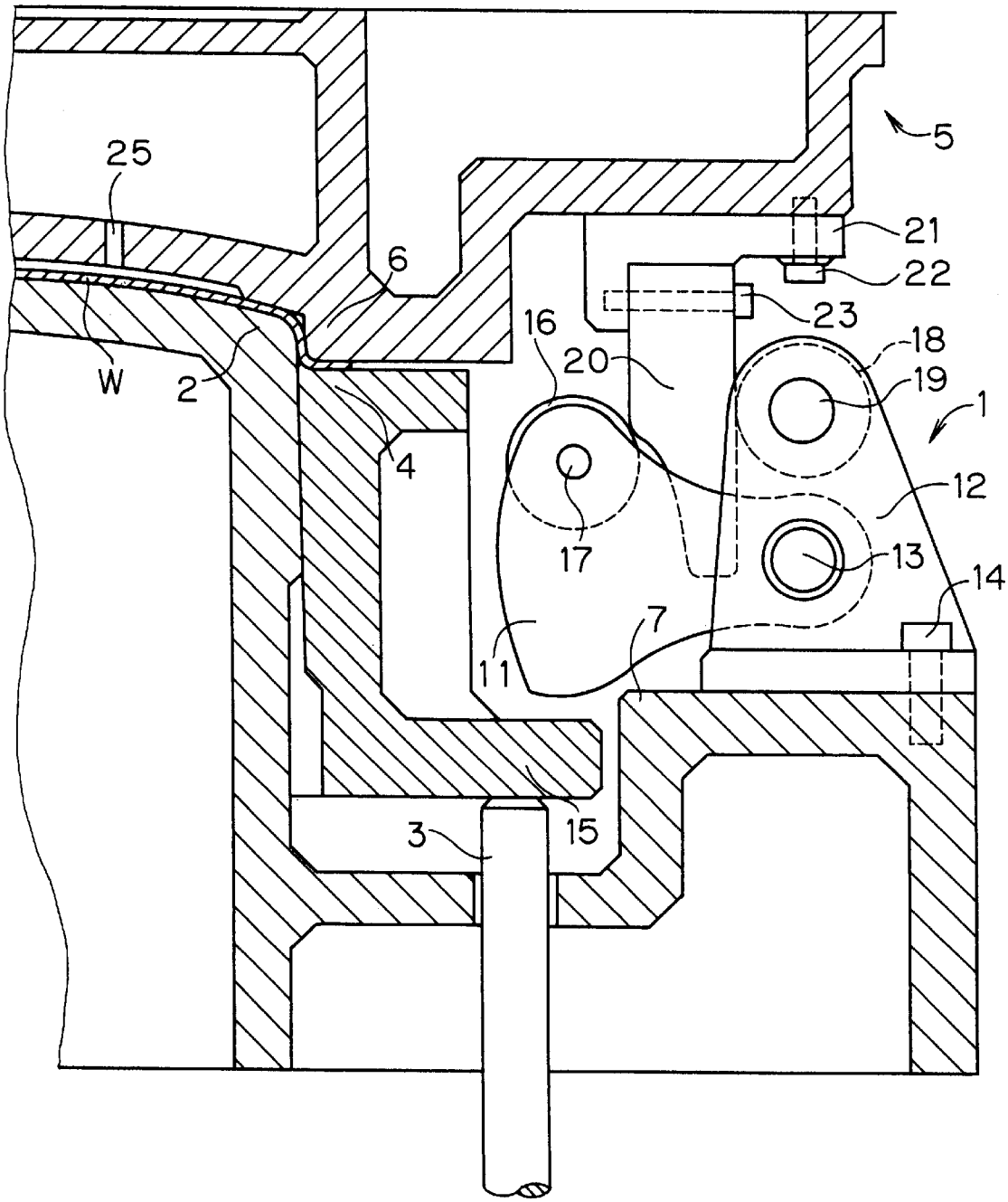
FIG. 3 is a vertical sectional view of an essential portion showing a state of the bottom dead center in which an upper die is further lowered from the state shown in FIG. 2 of the invention and the drawing is completed.

Then, the upper die 5 is subsequently lowered and the drawing is completed at the bottom dead center shown in FIG. 3, thereby forming the workpiece W.

When the upper die 5 moves upward, the workpiece W is removed from the punch 2 by the blank holder 4. The die 6 is provided with an air vent 25 so that a negative pressure is prevented from being generated between the workpiece W and the die 6 when the workpiece W is dropped by its own weight. Alternatively, the workpiece W may be moved out from the die 6 by a push-out pin (not shown) biased by a spring.

If various parts having different size such as the run-up lever 11, the bracket 12, the operation cam 20 and the like (including the roller 16, the roller 18, the supporting shafts 17, 19 and the supporting mount 21) are prepared as standard parts, the existing drawing die can easily be changed to a drawing die having the silent structure.

Figure 4:
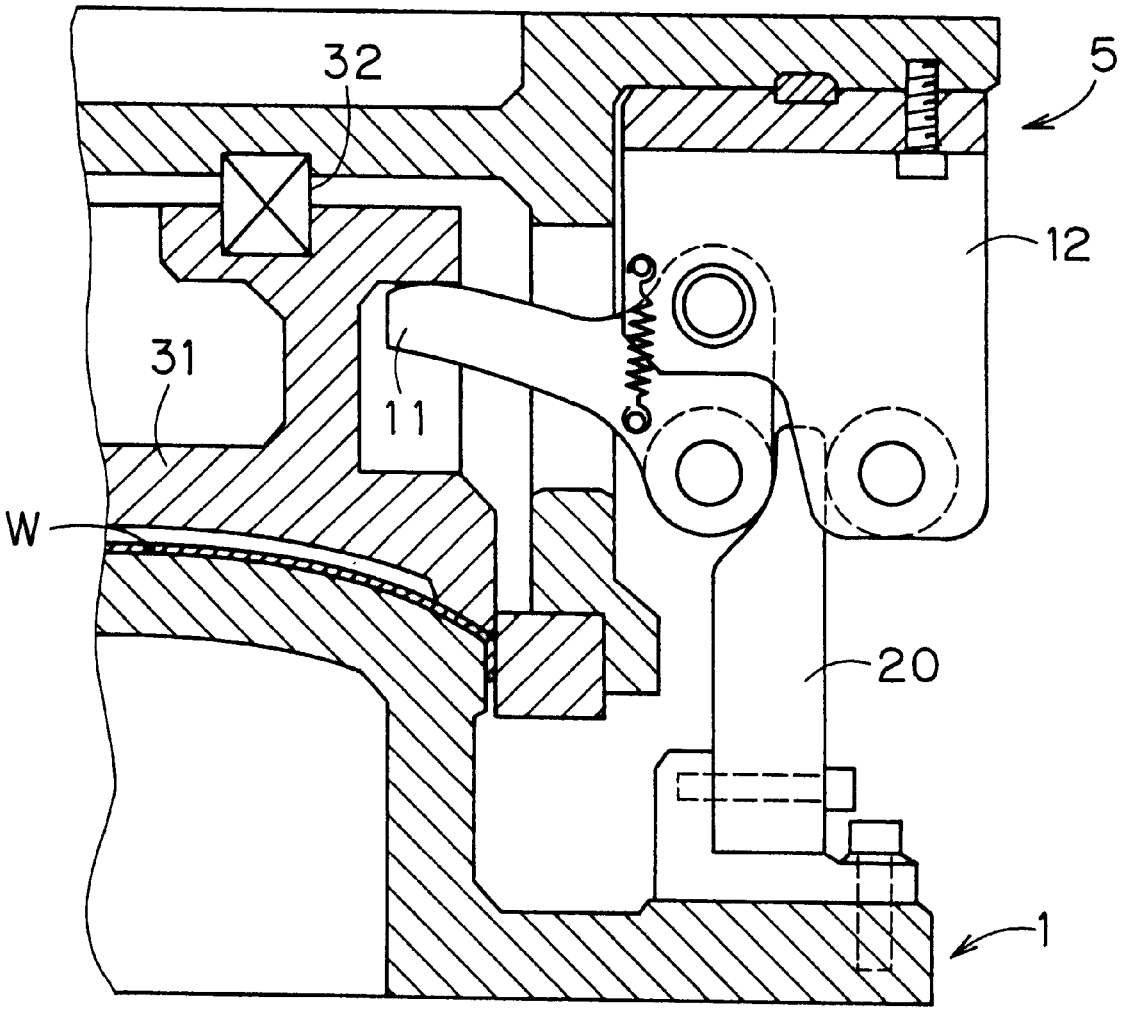
FIG. 4 is a vertical sectional view of a pressing die comprising a lower die provided with an operation cam, and the upper die provided with the run-up lever and a bracket.

Although the run-up lever 11 and the bracket 12 are mounted to the lower die 1 and the operation cam 20 is mounted to the upper die 5 in the above-described example, even if the run-up lever 11 and the bracket 12 are mounted to the upper die 5 and the operation cam 20 is mounted to the lower die 1 as shown in FIG. 4, the silent effect can be obtained. In this case, although a pad 31 is biased by a spring 32, since the pad collides against the workpiece W after the pad runs up by the run-up lever 11 and the operation cam 20, the silent effect can be obtained.

Further, in the present invention, when the thin plate is bent or is bent twice, i.e., when one end thereof is bent downwardly and the other end is bent upwardly, the pad runs up first and then the thin plate or the workpiece is sandwiched, thereby obtaining the silent effect.

Figure 5:
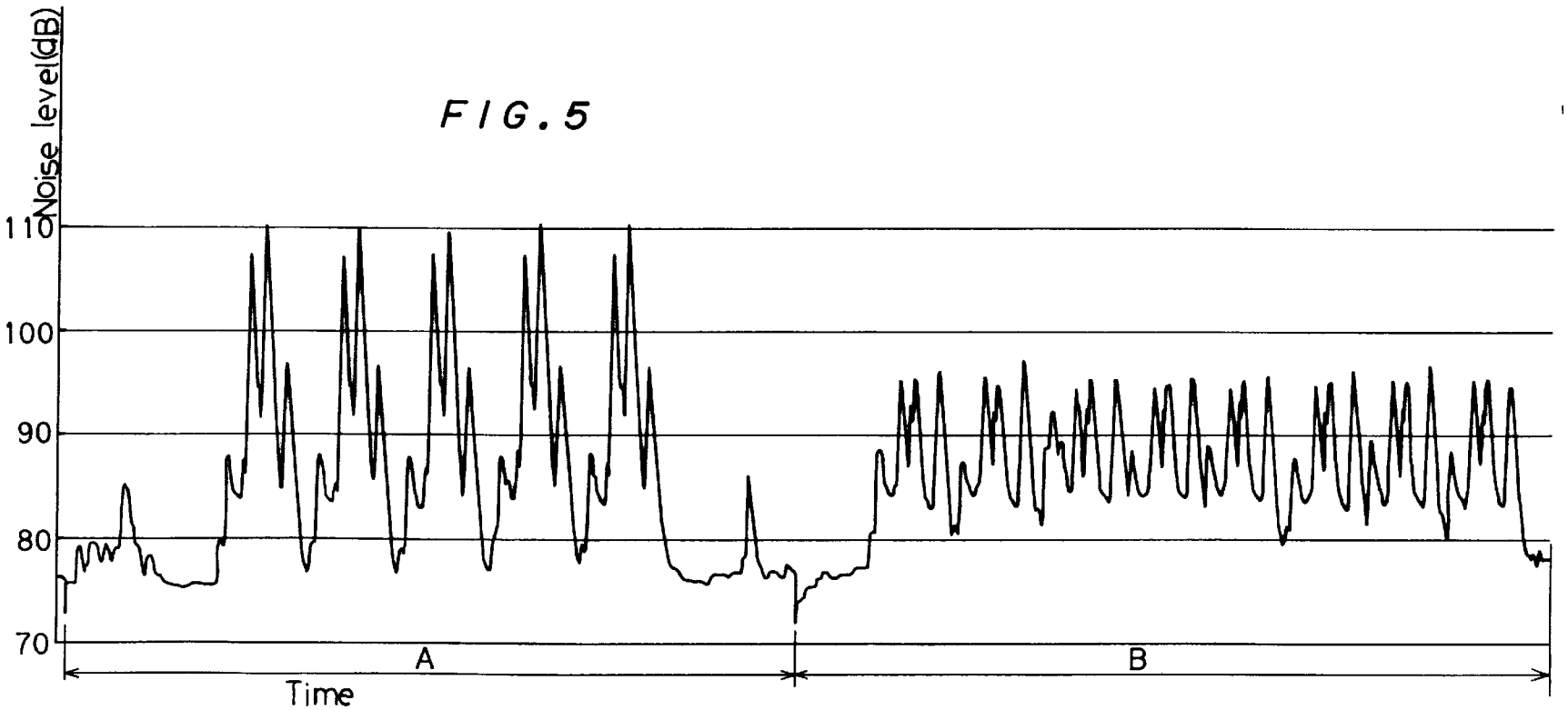
FIG. 5 is a graph comparing a case in which a silent structure is not mounted to the drawing die and a case in which a silent structure is mounted to the drawing die.

With reference to FIG. 5, description will be made concerning an example comparing a case in which this silent structure is not mounted to the drawing die and a case in which the silent structure is mounted to the drawing die.

In FIG. 5, the axis of abscissas shows time, and the axis of ordinates shows noise level (dB). A noise meter is disposed in front of a front surface of the pressing machine and the noise is continuously recorded in a recorder.

In FIG. 5, a region A shows a case in which the silent structure was not mounted, and a region B shows a case in which the silent structure was mounted. When the silent structure was not mounted, the maximum noise level was 110 dB. Although the maximum noise level is set at 110 dB as shown in FIG. 5, since the noise meter was off-scale, it is estimated that the actual maximum noise level was 115 to 120 dB. When the silent structure was mounted, the maximum noise level was about 95 dB. In the illustrated example, the reduced amount of the noise level was 15 dB, and it is estimated that the actual reduced amount was 20 to 25 dB. FIG. 5 shows only one experiment result, but the experiment was repeated and the same data was obtained.

Figure 7:
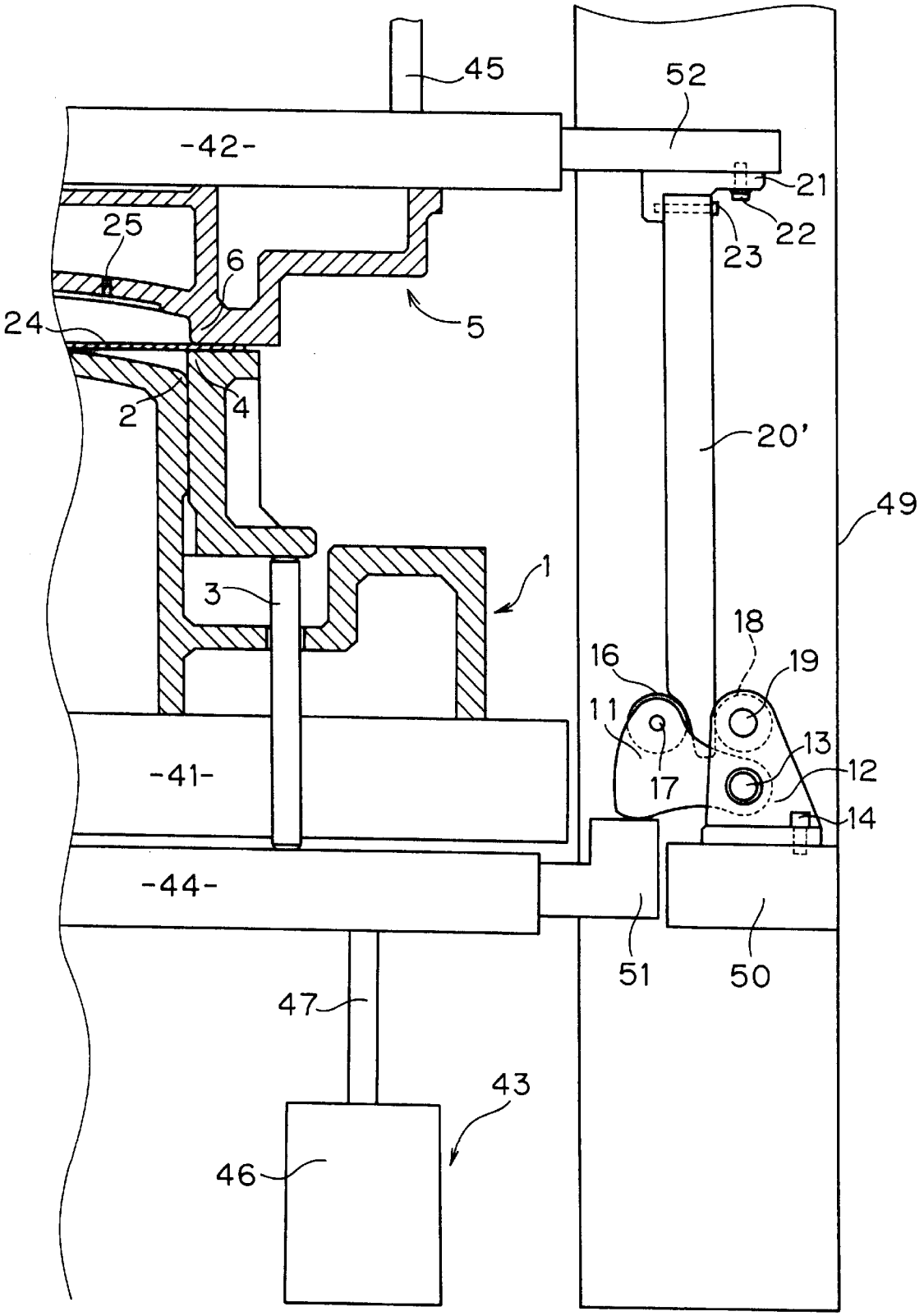
FIG. 7 is a schematic view of an essential portion showing the state in which the blank holder of the invention runs up and abuts against the thin plate on the blank holder.
Figure 8:
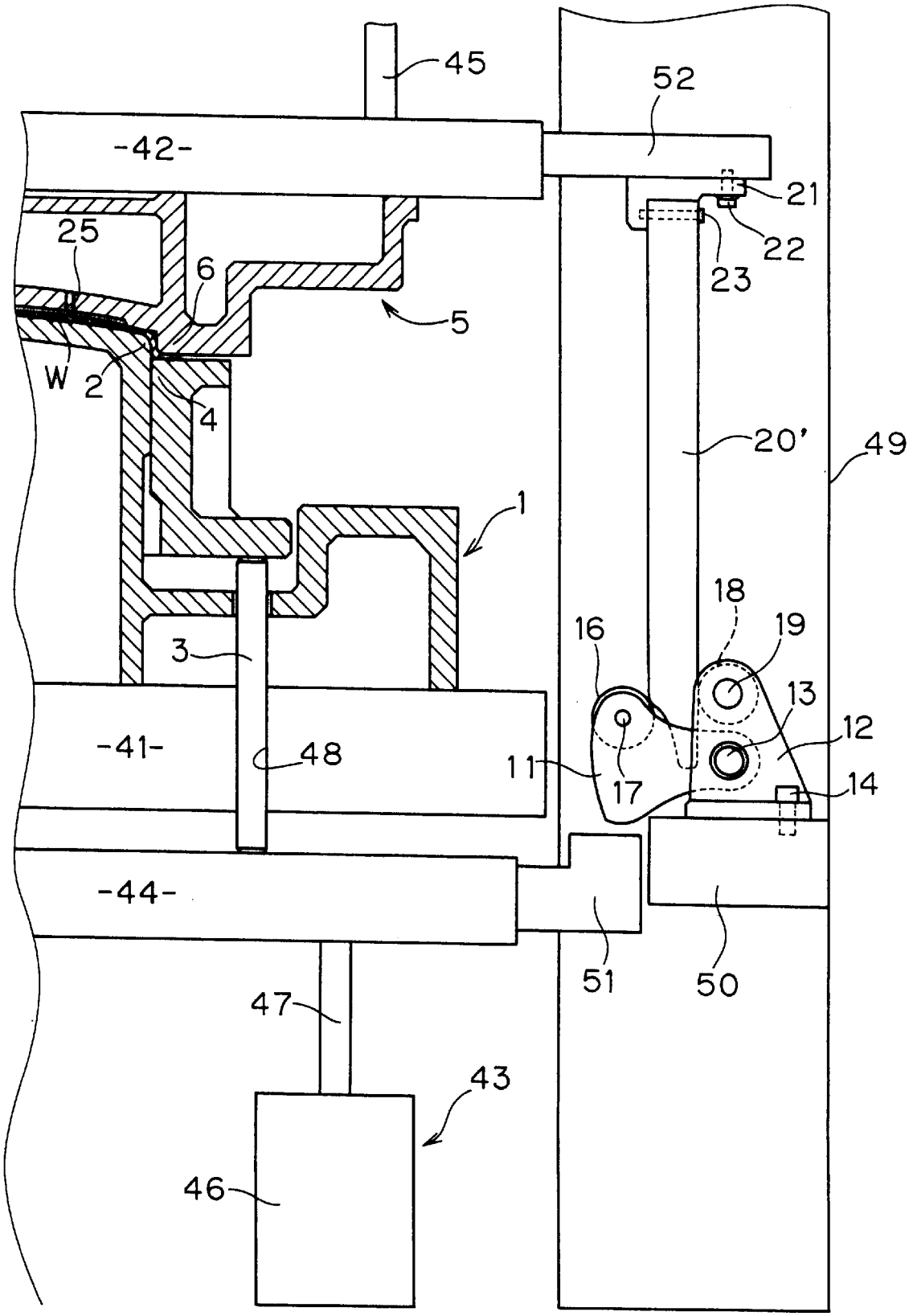
FIG. 8 is a schematic view of an essential portion showing the state of the bottom dead center in which the upper die is further lowered from the state shown in FIG. 7 of the invention and the drawing is completed.
Figure 9:
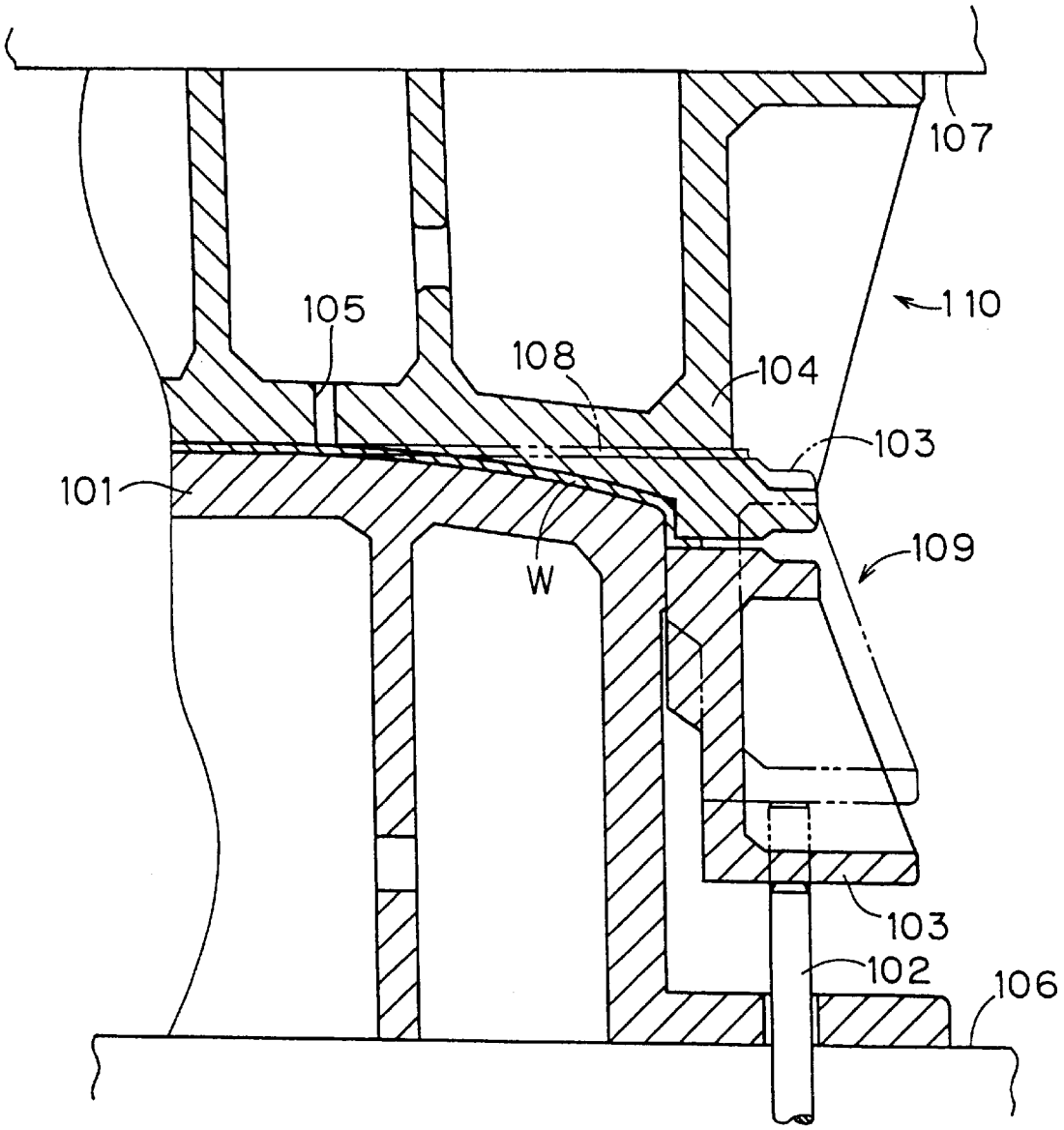
FIG. 9 CONVENTIONAL ART
FIG. 9 is a vertical sectional view of a conventional drawing die.

Next, an example in which the silent structure is mounted to the pressing machine is described with reference to the schematic views of FIGS. 6 to 8.

The pressing machine comprises a stationary bed 41, a ram 42 which is vertically moved with respect to the bed 41, and a pad 44 of a cushion device 43 located below the bed 41 for biasing a cushion pin 3 upwardly.

The ram 42 is vertically moved through a connecting rod 45, and an upper die 5 of a drawing die is fixed to a lower surface of the ram 42. The drawing die is the same as that described with reference to FIGS. 1 to 3.

A lower die 1 is fixed to an upper surface of the stationary bed 41, a blank holder 4, fitted around a punch 2, is supported by the cushion pin 3, and a die 6 of the upper die 5 is disposed so as to be opposed to the punch.

The pad 44 is connected to a tip end of a piston rod 47 of a hydraulic pressure cylinder 46 of a cushion device 43. The cushion pin 3 is inserted to a guide hole 48 of the bed 41 and is positioned between the upper surface of the pad 44 and the lower surface of the blank holder 4, the pressure of the cushion device 43 is transmitted to the blank holder 4, a thin plate 24 placed on the blank holder 4 and the punch 2 is sandwiched between the blank holder 4 and the die 6 and is lowered and drawn by the punch 2. The length of the cushion pin 3 is determined in correspondence with the drawn depth of the workpiece W.

The reference number 49 represents a hollow column standing at the side of the pressing machine. An essential portion of the silent structure can be accommodated in the hollow column 49. It is needless to say that the silent structure can be provided outside the hollow columnar.

A stationary member 50 is fixed in the hollow column 49 in the vicinity of the side portion of the pad 44. The pad 44 of the stationary member 50 is provided with a pressure-receiving portion 51. The ram is also formed at its side with a supporting portion 52 at a position facing the pressure-receiving portion and the stationary member 50. The pressure-receiving portion 51 and the pad 44 may be integrally formed, and other members may be fixed. The supporting member 52 and the ram 42 may be integrally formed, and other members may be fixed.

The silent structure is provided with the supporting portion 52, the stationary member 50 and the pressure-receiving portion 51. This silent structure is the same as that described with reference to FIGS. 1 to 3 except that the length of an operation cam 20' is longer. The bracket 12 is fixed to the stationary member 50 by a bolt 14, the run-up lever 11 is rotatably provided around the center shaft 13, the run-up lever 11 can abut against an upper surface of the pressure-receiving portion 51, and the rollers 16, 18 are rotatably provided around the supporting shafts 17, 19 at the upper portions of the run-up lever 11 and the bracket 12, respectively.

The operation cam 20' is disposed at positions facing the rollers 16, 18, and is mounted to a supporting portion 52 through the supporting mount 21. The operation cam 20' is fixed to the supporting mount 21 by the bolt 23, and the supporting mount 21 is fixed to the supporting portion 52 by the bolt 24.

The operation of the pressing machine will be explained next.

The thin plate 24 is placed on the punch 2 and the blank holder 4.

Figure 6:
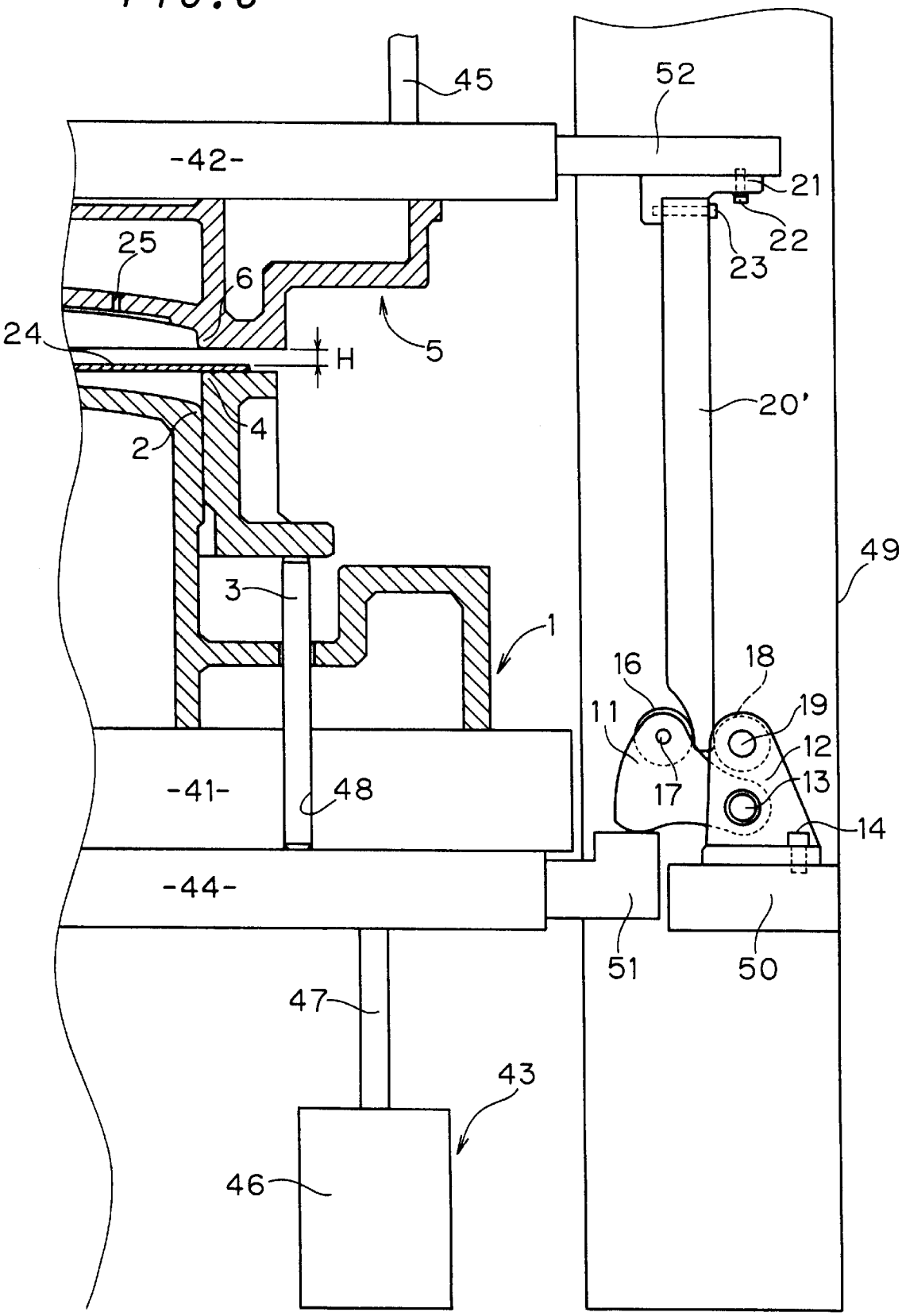
FIG. 6 is a schematic view of an essential portion showing the state in which the run-up lever of the invention starts operating.

FIG. 6 shows a state in which the ram 42 is lowered and the run-up lever 11 starts abutting against the pressure-receiving portion 51 by the operation cam 20'. A run-up clearance H between the blank holder 4 and the die 6 shown in FIG. 6 is set to such a value that the blank holder 4 collides against the die 6 after the run-up and a silent effect can sufficiently be obtained.

The run-up lever 11 pushes the upper surface of the pressure-receiving portion 51 downwardly, thereby lowering the pad 44. With this movement, the cushion pin 3 and the blank holder 4 are moved downwardly, the blank holder 4 is allowed to run up downwardly, and the die 6 abuts against the thin plate 24 on the blank holder 4. FIG. 7 shows this state. A clearance exists between the upper surface of the pad 44 and the lower surface of the bed 41, the cushion pin 3 is moved downwardly by the distance of this clearance, and the blank holder 4 is also moved downwardly. The die 6 abuts against the thin plate 24 on the running blank holder 4 not against the thin plate 24 on the stationary blank holder 4. Since the die 6 does not collide against the stationary thin plate 24 but collides against the running thin plate 24, little noise is generated.

Then, the upper die 5 is subsequently lowered and the drawing is completed at the bottom dead center shown in FIG. 8, thereby forming the workpiece W.

When the upper die 5 moves upwardly, the workpiece W is removed from the punch 2 by the blank holder 4. The die 6 is provided with an air vent 25 so that the negative pressure is prevented from being generated between the workpiece W and the die 6 when the workpiece W is dropped by its own weight. Alternatively, the workpiece W may be moved out from the die 6 by a push-out pin (not shown) biased by a spring.

Since the operation cam 20' becomes long, it is preferable to provide a guide, and the length thereof must be determined in accordance with the height of the pressing die. It is preferable to prepare some operation cams having different length or to prepare an operation cam which is extendable mechanically or by air pressure or hydraulically.

Although the silent structure of the pressing machine has been described above, the silent structure can also be applied to a processing machine of metal or resin.

As described above, according to the present invention, there is provided a silent structure of a processing machine comprising a stationary bed, a movable ram vertically movable with respect to the bed, a movable member vertically movable with respect to the bed, a pad of a cushion device located below the bed for biasing a cushion pin upwardly, wherein the stationary member is rotatably provided with a run-up lever, the movable member facing the run-up lever is vertically provided with an operation cam, the operation cam acts on the run-up lever before mounted working tools sandwich a workpiece, and the pad is allowed to run up. Therefore, it is possible to reduce noise generated by the processing machine as much as possible.

Further, according to the invention, there is provided a silent structure of a pressing machine comprising a stationary bed, a ram vertically movable with respect to the bed, a pad of a cushion device located below the bed for biasing a cushion pin upwardly, wherein the stationary member is rotatably provided with a run-up lever, the ram facing the run-up lever is vertically provided with an operation cam, the operation cam acts on the run-up lever before mounted pressing dies sandwich a thin plate or a workpiece, and the pad is allowed to run up. Therefore, it is possible to reduce a noise generated by the pressing machine as small as possible.

Further, according to the invention, there is provided a silent structure of a drawing die comprising a punch, a blank holder fitted around the punch and vertically movably supported by a cushion pin, and a vertically movable die disposed such as to face the punch, a thin plate being placed on a blank holder which is moved up by the cushion pin, the die being lowered, thereby sandwiching the thin plate between the blank holder and the die for drawing the thin plate by the punch, wherein a lower die base plate is rotatably provided with a run-up lever for pushing the blank holder for allowing the latter to run up before the die collides against the thin plate, an operation cam for driving the run-up lever is disposed at a position on the die facing the run-up lever, and the die collides against the thin plate on the blank holder after the blank holder runs up. Therefore, it is possible to reduce noise as compared with a case in which the die collides against a thin plate of a stationary blank holder. The present invention can be used as a silent structure for improving the existing drawing die if the run-up lever and the operation cam are formed as a unit.

Furthermore, in the invention, the run-up speed of the blank holder can be controlled by variously changing the tilt angles of the cam surface of the operation cam.

Further, in the invention, since a silent run-up unit having a run-up lever and an operation cam for driving the run-up lever, the existing drawing die can easily be improved to include the silent structure.

Further, in the invention, since a silent structure of a pressing die comprising a lower die provided with an operation cam, and an upper die provided at its position facing the operation cam with a run-up lever, it can be expected that the noise of a noise source is reduced by the pad of the upper die.

Furthermore, according to the invention, in a pressing die for sandwiching a thin plate or a workpiece to machine the same, the thin plate or the workpiece is allowed to run up before the thin plate or the workpiece is sandwiched. Therefore, it can be expected that a noise of the pressing die is reduced.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A noise-reducing structure of a processing machine comprising:

a stationary member;

a movable member disposed adjacent to and opposing said stationary member;

a holder member disposed adjacent to said stationary member, said holder member being movable with respect to said stationary member;

a support member fixed to said stationary member;

a lever member pivotally attached to said support member, said lever member being engagable with said holder member; and an operating member fixed to said movable member, said operating member being engagable with said lever member upon movement of said movable member, thereby pivoting said lever member and moving said holder member with respect to said stationary member.

2. The noise-reducing structure according to claim 1, wherein said processing machine is a pressing machine, said stationary member includes a punch, and said movable member includes a die.

3. The noise-reducing structure according to claim 2, wherein said holder member comprises a blank holder fitted around said punch.

4. The noise-reducing structure according to claim 1, further comprising a cushioning device for cushioning displacement of said holder member.

5. The noise-reducing structure according to claim 4, wherein said cushioning device includes a cushion pin passing through an aperture in said stationary member and abutting said holder member.

6. The noise-reducing structure according to claim 1, wherein said operating member comprises an operating cam.

7. The noise-reducing structure according to claim 6, wherein said operating cam includes a cam surface having a varying inclination angle for varying a speed of movement of said lever member and said holder member.

8. The noise-reducing structure according to claim 7, wherein said support member includes a first roller, said lever member includes a second roller, and said operating cam is insertable between said first roller and said second roller such that said cam surface engages said second roller.

9. The noise-reducing structure according to claim 1, wherein said support member comprises a bracket attached to said stationary member, said bracket supporting a shaft for providing pivotal movement of said lever member with respect to said bracket.

10. The noise-reducing structure according to claim 1, wherein said processing machine is a pressing machine, said stationary member includes a punch, said movable member includes a die, said holder member comprises a blank holder fitted around said punch, said operating member comprises an operating cam, said operating cam including a cam surface having a varying inclination angle for varying a speed of movement of said lever member and said blank holder, said support member including a first roller, said lever member including a second roller, said operating cam being insertable between said first roller and said second roller such that said cam surface engages said second roller.

11. The noise-reducing structure according to claim 10, further comprising a cushioning device for cushioning displacement of said blank holder, said cushioning device including a cushion pin passing through an aperture in said stationary member and abutting said blank holder, and said support member comprising a bracket attached to said stationary member, said bracket supporting a shaft for providing pivotal movement of said lever member with respect to said bracket.

12. A noise-reducing structure of a processing machine comprising:

a stationary member;

a movable member disposed adjacent to and opposing said stationary member;

a pad member operatively attached to said movable member, said pad member being movable with respect to said movable member;

a support member fixed to said movable member;

a lever member pivotally attached to said support member, said lever member being engagable with said pad member; and an operating member fixed to said stationary member, said operating member being engagable with said lever member upon movement of said movable member, thereby pivoting said lever member and moving said pad member with respect to said movable member.

13. The noise-reducing structure according to claim 12, further comprising a cushioning device for cushioning displacement of said pad member with respect to said movable member.

14. The noise-reducing structure according to claim 13, wherein said cushioning device includes a spring.

15. The noise-reducing structure according to claim 12, wherein said operating member comprises an operating cam.

16. The noise-reducing structure according to claim 15, wherein said operating cam includes a cam surface having a varying inclination angle for varying a speed of movement of said lever member and said pad member.

17. The noise-reducing structure according to claim 16, wherein said support member includes a first roller, said lever member includes a second roller, and said operating cam is insertable between said first roller and said second roller such that said cam surface engages said second roller.

18. The noise-reducing structure according to claim 12, wherein said support member comprises a bracket attached to said movable member, said bracket supporting a shaft for providing pivotal movement of said lever member with respect to said bracket.

19. A noise-reducing structure of a processing machine comprising:

a stationary member;

a movable member disposed adjacent to and opposing said stationary member;

a holder member disposed adjacent to said stationary member, said holder member being movable with respect to said stationary member;

a cushioning device for cushioning displacement of said holder member;

a stationary support member disposed adjacent to said stationary member;

a lever member pivotally attached to said stationary support member, said lever member being engagable with a portion of said cushioning device; and an operating member fixed to said movable member, said operating member being engagable with said lever member upon movement of said movable member, thereby pivoting said lever member and moving said cushioning device with respect to said stationary member, and permitting movement of said holder member with respect to said stationary member.

20. The noise-reducing structure according to claim 19, wherein said processing machine is a pressing machine, said stationary member includes a punch, and said movable member includes a die.

21. The noise-reducing structure according to claim 20, wherein said holder member comprises a blank holder fitted around said punch.

22. The noise-reducing structure according to claim 19, wherein said cushioning device includes a cushion pin passing through an aperture in said stationary member.

23. The noise-reducing structure according to claim 22, wherein said cushioning device further includes a cushion pad, said cushion pin extending between said holder member and said cushion pad.

24. The noise-reducing structure according to claim 23, wherein said cushion pad includes a pressure-receiving portion, said lever member engaging said pressure-receiving portion of said cushion pad.

25. The noise-reducing structure according to claim 19, wherein said operating member comprises an operating cam.

26. The noise-reducing structure according to claim 25, wherein said operating cam includes a cam surface having a varying inclination angle for varying a speed of movement of said lever member and said holder member.

27. The noise-reducing structure according to claim 26, wherein said support member includes a first roller, said lever member includes a second roller, and said operating cam is insertable between said first roller and said second roller such that said cam surface engages said second roller.

28. The noise-reducing structure according to claim 19, wherein said stationary support member comprises a bracket attached to said stationary support member, said bracket supporting a shaft for providing pivotal movement of said lever member with respect to said bracket.

29. The noise-reducing structure according to claim 19, wherein said processing machine is a pressing machine, said stationary member includes a punch, said movable member includes a die, said holder member comprises a blank holder fitted around said punch, said operating member comprises an operating cam, said operating cam including a cam surface having a varying inclination angle for varying a speed of movement of said lever member and said blank holder, said support member including a first roller, said lever member including a second roller, said operating cam being insertable between said first roller and said second roller such that said cam surface engages said second roller.

30. The noise-reducing structure according to claim 29, wherein said cushioning device includes a cushion pin passing through an aperture in said stationary member, and a cushion pad, said cushion pin extending between said blank holder and said cushion pad, said cushion pad including a pressure-receiving portion, said lever member engaging said pressure-receiving portion of said cushion pad.

31. The noise-reducing structure according to claim 30, wherein said stationary support member comprises a bracket attached to said stationary support member, said bracket supporting a shaft for providing pivotal movement of said lever member with respect to said bracket.

* * * * *